United States Patent [19]

Johnston

[11] 4,043,557

[45] Aug. 23, 1977

[54] APPARATUS AND METHOD INVOLVING THE CHANCE SELECTION OF SOUND RECORDED RACE RESULTS

[76] Inventor: Grant Johnston, 7722 Savannah Drive, Bethesda, Md. 20034

[21] Appl. No.: 664,023

[22] Filed: Mar. 4, 1976

[51] Int. Cl.[2] ..... A63F 9/00

[52] U.S. Cl. ..... 273/86 R; 273/138 A

[58] Field of Search ..... 273/86 A, 134 CH, 138 R, 273/138 A, 86 R; 35/8 A

[56] References Cited

U.S. PATENT DOCUMENTS 3,779,552 12/1973 Buck ..... 273/94 R

FOREIGN PATENT DOCUMENTS 164,265 7/1955 Australia ..... 273/138 R

*Primary Examiner*—Anton O. Oechsle

*Attorney, Agent, or Firm*—Larson, Taylor & Hinds

[57] ABSTRACT

A horse racing game and an apparatus including playing cards, dice members, play money and recorded sound for the play of the field are disclosed. The playing cards are marked to identify the race contestants and are dealt to the players. The play money is used by the players to bet on the race contestants. The dice are thrown to provide a random selection of a sound track of the recorded sound. The sound tracks have prerecorded thereon accounts of races between the race contestants and the accounts have different finishing orders among the contestants. Preferably, the sound tracks are in the form of magnetic tape cassettes and each throw of the dice results in the selection of a selected side of a selected cassette.

3 Claims, 5 Drawing Figures

APPARATUS AND METHOD INVOLVING THE CHANCE SELECTION OF SOUND RECORDED RACE RESULTS

BACKGROUND OF THE INVENTION

This invention relates to a game and game apparatus; more particularly to a horse racing game that may be played by a plurality of people for their mutual enjoyment.

The prior art teaches a variety of horse racing type games, such as for example as is disclosed in U.S. Pats. No. 3,054,218; 3,295,851; 3,441,277; 3,338,577; 3,781,011; 3,729,193; 3,785,649; 3,815,912; and others. None of the foregoing however, enjoy the game device as is instantly taught.

SUMMARY OF THE INVENTION

It is accordingly an object of the instant invention to provide for a new and improved horse race game.

It is another object to provide for game pieces for playing the game.

It is a further object to provide for the same at relatively little cost thereby making it generally available.

These and other objects and advantages of the game will become more apparent from the following detailed disclosure and claims and by reference to the accompanying drawings, in which:

Broadly speaking, the instant invention includes the provision of a horse race game, comprising at least one pre-recorded sound track containing complete horse race grandstand announcements thereon, means for audibly playing the sound track, a plurality of numbered cards, at least one pair of dice and a plurality of play money of varying denominations whereby the sound track is played, the money is bet and the cards are distributed among the players.

DETAILED DISCLOSURE

Figure 1:
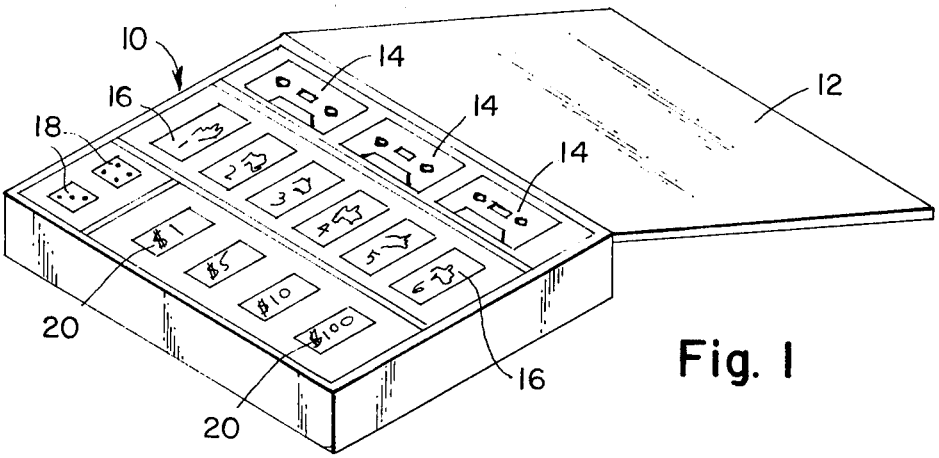
FIG. 1 is a plan view of the game piece container.
Figure 2:
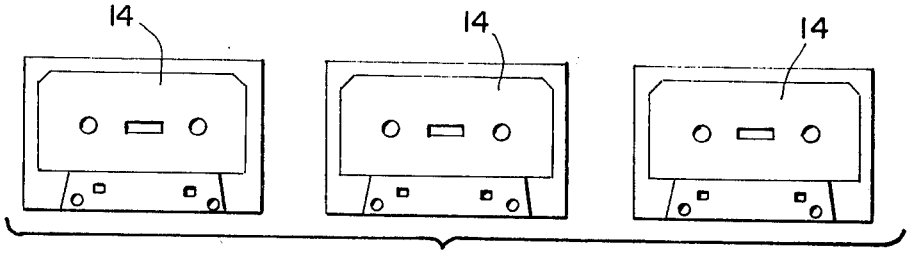
FIG. 2 - FIG. 5 are views of the pieces needed for playing the game.
Figure 3:
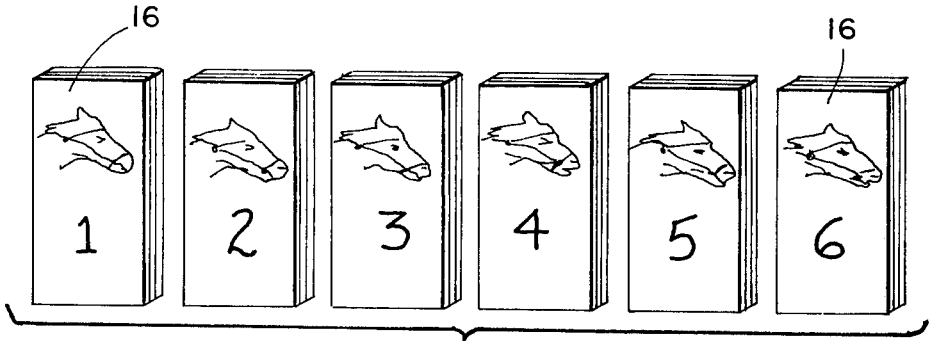
Figure 4:
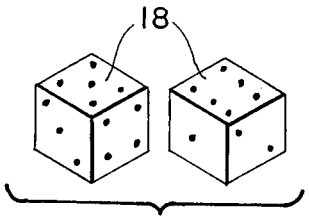
Figure 5:
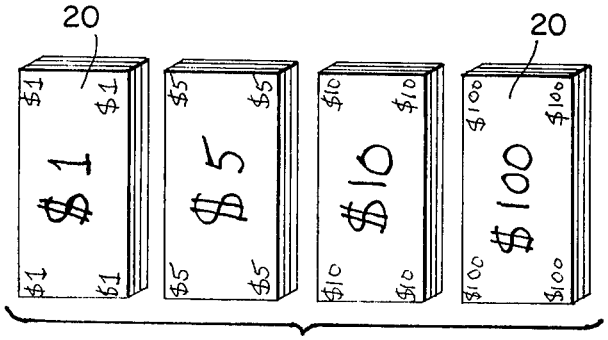

Referring more particularly to the drawings, there is shown a game piece carrying case 10 that may have any particular suitable shape and which is adapted to hold the various members needed for the playing of the game. The case 10 will generally be walled, define a cavity therebetween and include a suitable cover portion 12. The game pieces (as shown in FIG. 1) will preferably sit in the case 10, each in their own respective pocket or recess for holding the same secure when the game is not in play. The game will also include a plurality of pre-recorded play material on a suitable sound track 14 such as tapes, cassettes, records, etc. A plurality of playing cards 16 are also provided; the cards 16 each contain printed matter thereon relative to the game. A pair of conventional dice 18 are also provided for the play as is a plurality of play money 20 having a variety of denominations.

The actual play of the game may be varied somewhat from the following description relative thereto, which is given as a general guideline for the play of the game.

Materials preferred for the play:

1. THREE PRE-RECORDED CASSETTES—six sides, each side of the cassette contains six races with six horses in each race. The three cassettes (six sides) have a total of thirty six races. Each race is narrated by a calling of the running of the race from parade to the post final results. Of the thirty six races, six races will be won by No. 1 horse, six by No. 2, six by No. 3, etc. This holds true to the PLACE and SHOW positions also. The winners of WIN-PLACE-SHOW will be alternated as to winners on the line-up of recordings.

It is to be understood that any form of sound track may be employed with the proviso that the above guidelines are followed.

2. TWENTY FOUR CARDS with pictures of a horse and a number one through six on each card. Four cards have No. 1 horse, four cards have No. 2 horse, for cards of No. 3 horse, etc. There are four sets of cards No. 1 through No. 6.

3. TWO STANDARD DICE

4. PACKAGE OF PLAY MONEY in denominations of $1, $5, $10 and $100.

HOW TO PLAY THE GAME

Step 1: Distribute play money equally among all participants.

Step 2: Those playing the game (two or more persons) put up an 'ante' to participate. If two, three or six play, a six card deck is used (horses numbered one through six). If 7 through 12 persons participate, two sets of cards are used. If 13 through 18 persons play, three sets of cards are used. If there are 19 through 24 persons, four sets of cards will be used, etc.

Assume that two persons are playing; each person will be dealt three cards. The numbered cards represent the horses he owns for the upcoming race, in the WIN position. A second deck of six cards can be dealt for PLACE horses, a third deck can be dealt for SHOW horses.

If four people play, two cards will remain unclaimed. If five people play, one card will remain unclaimed. The unclaimed card can be disposed of by the bidding of participants on the unclaimed cards. Highest amount bid takes the card. After which all bets are frozen (no more bets can be taken).

Step 3: One dice is rolled, the number coming up on the dice represents the number of the cassette to be played.

Step 4: Cassette is played one race at a time after each betting.

METHODS OF PAY-OFFS

Total Pool

Winner of race takes entire pool of bets

| | | | | | | | |
|---|---|---|---|---|---|---|---|
| Horse | No. 1 | No. 2 | No. 3 | No. 4 | No. 5 | No. 6 | |
| Amount bet | $2 | $2 | $2 | $2 | $2 | $2 | Total $12 |

Winner takes home $12

Same method is used for PLACE and SHOW betting

Hunch Bets Added to Pool

Hunch bets can be made by placing money on horses owned by other players.

| | | | | | | | |
|---|---|---|---|---|---|---|---|
| Horse | No. 1 | No. 2 | No. 3 | No. 4 | No. 5 | No. 6 | |
| Amount bet | $2 | $2 | $2 | $2 | $2 | $2 | Total $12 |
| Hunch bets | $0 | $4 | $2 | $0 | $2 | $0 | Total $ 8 |
| | | | | | | | Grand Total $20 |

Shaving the Odds

Shaving the odds on pay-off can be done by the following method so that a bank can be built up to be used as a subsequent purse-added race.

Straight Method:

| | | | | | | | |
|---|---|---|---|---|---|---|---|
| Horse | No. 1 | No. 2 | No. 3 | No. 4 | No. 5 | No. 6 | |
| Amount bet | $4 | $2 | $4 | $4 | $2 | $4 | Total $20 |
| Odds | 5/1 | 10/1 | 5/1 | 5/1 | 10/1 | 5/1 | |
| | $20 | $20 | $20 | $20 | $20 | $20 | |

Shaved Odds Method:

| | | | | | | | |
|---|---|---|---|---|---|---|---|
| Horse | No. 1 | No. 2 | No. 3 | No. 4 | No. 5 | No. 6 | |
| Amount bet | $4 | $2 | $4 | $4 | $2 | $4 | Total $20 |
| Odds shaved | 4/1 | 8/1 | 4/1 | 4/1 | 8/1 | 4/1 | Pay-off $16 |

This leaves $4 for the house to add to a purse for a subsequent race or races.

If the total amount bet comes to an uneven amount such as $22, the extra $2 is added to the house purse for subsequent race-added purses.

NOTE: Daily doubles and exactas can be played by creating daily double pools and exacta pools on appropriate races.

NOTE: If all horses are not covered by bets and an uncovered horse should win the total pool, the unclaimed total will be added to the next race.

NOTE: If twelve cassettes are used, both dice are used. Cassette side one becomes inoperative.

NOTE: If during an evening's race meet, cassette side runs out, the cassette will be rewound to the top (first race) and used again. Never rewind the cassette side until all the races have been run.

NOTE: To further enthusiasm for the game after the horses have been announced (parade to the post), the cassette can be stopped and odds announced based on the bets made.

| | | | | | | | |
|---|---|---|---|---|---|---|---|
| Horse | No. 1 | No. 2 | No. 3 | No. 4 | No. 5 | No. 6 | |
| Bets | $4 | $6 | $4 | $10 | $4 | $2 | Total $30 |
| Odds | 7/1 | 5/1 | 7/1 | 3/1 | 7/1 | 15/1 | |

If No. 1, No. 3, and No. 5 should win, the extra $2 left over would be used for subsequent purse-added race.

Purse Added Example:

-continued

| | | | | | | | |
|---|---|---|---|---|---|---|---|
| Horse | No. 1 | No. 2 | No. 3 | No. 4 | No. 5 | No. 6 | |
| Amount bet | $4 | $2 | $4 | $4 | $2 | $4 | Total $20 |
| | | | | | | | Purse Added $20 |

Since it is obvious that numerous changes and modifications can be made in the above-described details without departing from the spirit and nature of the invention, it is to be understood that all such changes and modifications are included within the scope of the invention.

I claim:

1. A simulated race game comprising at least one sound track having prerecorded thereon a plurality of accounts of races between a plurality of contestants, the race accounts having different finishing orders among the contestants, playback means for selectively audibly playing said race accounts, a plurality of betting cards for distribution to the game players, each of said cards being marked to indicate a contestant, at least one die for randomly selecting which of said race accounts is to be played, and simulated money to be bet by each player on the outcome of the race accounts selected for play with the betting cards distributed to each player indicating the contestants owned by the respective players.

2. The game of claim 1 wherein said at least one sound track is in the form of at least one magnetic tape cassette having two playing sides, each of said playing sides having a predetermined number of said race accounts recorded thereon, and the finishing orders of the race accounts are such that each contestant places first, second, and third in a substantially equal number of races.

3. A method of playing a game involving a plurality of players, wherein said game comprises at least one sound track having prerecorded thereon a plurality of accounts of races between a plurality of contestants, the race accounts having different finishing orders among the contestants, playback means for selectively audibly playing said race accounts, a plurality of betting cards for distribution to the game players, each of said cards being marked to indicate a contestant, at least one die for randomly selecting which of said race accounts is to be played, and simulated money to be bet by each player on the outcome of the race accounts selected for play and the betting cards distributed to each player, and said method comprises the steps of distributing a predetermined number of said betting cards to each of the players, each player in turn placing bets on at least the contestants indicated on his betting cards, rolling said at least one die to determine the race account to be played, playing the race account selected by the rolling of said at least one die, and distributing play money to the players who won their bets.

* * * * *